US005981687A

United States Patent [19]

Breen et al.

[11] Patent Number: 5,981,687

[45] Date of Patent: Nov. 9, 1999

[54] POLYMER COMPOSITIONS FOR DEMULSIFYING CRUDE OIL

[75] Inventors: Patrick J. Breen; James W. Towner, both of Houston, Tex.

[73] Assignee: Baker Hughes Incorporated, Houston, Tex.

[21] Appl. No.: 08/862,902

[22] Filed: May 23, 1997

Related U.S. Application Data

[62] Division of application No. 08/494,987, Jun. 26, 1995, Pat. No. 5,667,727.

[51] Int. Cl.[6] ..... B01D 17/04; C08G 59/22; C08G 65/22

[52] U.S. Cl. ..... 528/105; 528/98; 528/103; 528/104; 528/110; 516/163; 516/168; 516/179; 516/193

[58] Field of Search ..... 528/103, 105, 528/110, 98, 104; 252/331; 516/161, 163, 168, 179, 183, 191, 192, 193

[56] References Cited

U.S. PATENT DOCUMENTS

| | | | |
|---|---|---|---|
| 2,552,528 | 5/1951 | De Groote | 252/331 |
| 2,662,859 | 12/1953 | Kirkpatrick | 516/191 |
| 2,839,489 | 6/1958 | De Groote et al. | 528/103 |
| 2,944,979 | 7/1960 | De Groote et al. | 252/331 |
| 3,148,153 | 9/1964 | De Groote et al. | 516/193 |
| 3,334,147 | 8/1967 | Brunelle et al. | 516/193 |
| 3,383,325 | 5/1968 | Seale et al. | 252/331 |
| 3,383,326 | 5/1968 | Seale et al. | 252/331 |
| 3,579,466 | 5/1971 | Quinlan | 252/331 |
| 3,676,501 | 7/1972 | Seale et al. | 252/358 |
| 3,899,387 | 8/1975 | Freis et al. | 252/357 |
| 3,960,781 | 6/1976 | Freis et al. | 252/357 |
| 4,436,933 | 3/1984 | Diery | 562/470 |
| 4,528,106 | 7/1985 | Groltzer | 516/192 |
| 4,913,833 | 4/1990 | Otten et al. | 510/221 |
| 5,126,474 | 6/1992 | Topfl | 558/34 |

FOREIGN PATENT DOCUMENTS

| | | | |
|---|---|---|---|
| 147455 | 6/1950 | Australia | 528/103 |
| 0295031 | 12/1988 | European Pat. Off. . | |
| 1795662 | 1/1973 | Germany . | |

OTHER PUBLICATIONS

D. H. Reed, "Phenyl Isocyanate Method for Determination of Hydroxyl Equivalent Weight of Polyoxyalkylene Compounds," Reprint from *Analytical Chemistry*, vol. 35, No. 4, pp. 571–573, Apr., 1953.

*Primary Examiner*—Richard D. Lovering
*Assistant Examiner*—Daniel S. Metzmaier
*Attorney, Agent, or Firm*—Madan & Morris, PLLC

[57] ABSTRACT

Polymer compositions made by reacting a polyol with an aromatic hydrocarbon containing only a single reactive functionality have been discovered to be useful demulsifiers for crude oil compositions. The aromatic hydrocarbon should have at least one aryl group and only one functionality reactive with a hydroxyl. The polyol may optionally be crosslinked prior to reaction with the aromatic hydrocarbon, and the crosslinking agent may be a diepoxide.

7 Claims, No Drawings

POLYMER COMPOSITIONS FOR DEMULSIFYING CRUDE OIL

This is a divisional of application Ser. No. 08/494,987 filed on Jun. 26, 1995, now U.S. Pat. No. 5,667,727.

FIELD OF THE INVENTION

The present invention relates to polymer compositions of matter made by reacting a polyol and an aromatic hydrocarbon having a single functionality reactive therewith, and more particularly relates to use of the polymer compositions in the demulsification of oil and water emulsions, particularly crude oil emulsions.

BACKGROUND OF THE INVENTION

As crude petroleum rises from the reservoir, it passes through narrow openings, accompanied by water, gases and naturally occurring surfactants. The mixture is agitated as it is pumped up through the production tubing. Such conditions are favorable to the formation of crude petroleum emulsions. Oftentimes, wellbore solids are carried up and flushed out with the crude mixture. The wellbore solids, together with the naturally-occurring surfactants tend to stabilize the emulsions.

These petroleum emulsions cannot be processed further without first removing the major part of the water. The dehydration of petroleum emulsions is generally accomplished by techniques including, but not limited to, settling, heat treatments, centrifuging, by the application of electrical fields or by the addition of demulsifiers. Many petroleum emulsions are usually too stable to be broken solely by the mechanical processes mentioned above within the required time frames. The use of chemical demulsifiers has proven more effective in resolving crude petroleum emulsions. The chemical demulsifiers exert a direct influence on the interfaces of the crude petroleum emulsions and cause a breaking or separation of the petroleum emulsions at lower temperatures and with shorter treatment times than if the demulsifiers are not used.

A large number of patents describe the preparation of chemical demulsifiers. This is largely due to the fact that petroleum emulsions vary in their compositions and characteristics depending on a number of factors including, but not limited to, geographical location and production method. A demulsifier which works well with petroleum emulsions for one location may be ineffective in other locations. It is thus imprecise to say that because a demulsifier does not work well in all applications that it is a poor demulsifier.

For example, U.S. Pat. No. 2,839,489 describes a method of making phenolic polyepoxide modified oxyalkylation derivatives, which are in turn obtained by oxyalkylation of phenol-aldehyde resins. The phenolic polyepoxides used herein always have more than one epoxide group per molecule, and may include a portion of compounds having more than two epoxide groups per molecule. These derivatives are noted as useful as demulsifying agents in preventing, breaking or resolving emulsions of the water-in-oil type, and particularly petroleum emulsions.

Compositions of matter and breaking water-in-oil petroleum emulsions therewith are also subjects of U.S. Pat. No. 3,383,325. The compositions involve a substantially water-insoluble, at least partially oil-soluble product formed by the reaction of (A) a polyoxyalkylene alcohol in which the oxyalkylene groups consist essentially of a member from the group consisting of oxypropylene, oxybutylene and both oxypropylene and oxybutylene with at least one terminal 2-hydroxyethyl group and (B) a diglycidyl ether of a bis-phenol compound in which about 60% to 90% of said diglycidyl ether groups are reacted with the hydroxyl groups of said polyoxyalkylene glycol with the formation of ether linkages between the polyoxyalkylene glycol nuclei and the bis-phenol compound nuclei. The remaining, unreacted glycidyl ether groups of the resultant product are reacted with hydroxyl groups on (C) polyoxyalkylene groups of a polyoxyalkylated alkyl phenol-formaldehyde polycondensate with the formation of ether linkages between said reaction product of (A) and (B) and said polyoxyalkylated polycondensate.

U.S. Pat. No. 3,383,326 teaches compositions of matter for breaking petroleum emulsions of the water-in-oil type similar to that of U.S. Pat. No. 3,383,325 discussed immediately above. In the '326 patent, the compositions are the reaction product of an epoxide of a polyphenol and an adduct obtained by reacting ethylene oxide with a higher alkylene oxide adduct of a compound from the group of compounds consisting of hydroxyhydrocarbyl compounds and hydroxyhydrocarbylether compounds, said hydroxyhydrocarbyl compounds and hydroxyhydrocarbylether compounds containing up to 12 carbon atoms and 1 to 3 hydroxyl groups, and the oxyalkylene groups of said higher alkylene oxide adduct being from the group consisting of oxypropylene, oxybutylene and mixtures of oxypropylene and oxybutylene. U.S. Pat. No. 3,676,501 describes products of the reaction of polyoxyalkylene alcohols and diglycidyl ethers of bis-phenol compounds similar to those of the '325 and '326 patents discussed immediately above.

Demulsification processes using polyglycidyl polymers and copolymers thereof and derivatives thereof as demulsifiers are described in U.S. Pat. No. 3,579,466.

As noted, many emulsion breakers are very specific to certain areas and particular crude oil compositions. Most commercial emulsion breakers are formulations or blends of several chemicals. As the production field ages or more wells are put into production, new chemicals or new blends may have to be put into the system. Thus, there is a continuing need for new demulsifiers to address the varying crudes and conditions under which they are produced.

SUMMARY OF THE INVENTION

Accordingly, it is an object of the present invention to provide novel polymers useful in demulsifying crude oil emulsions.

It is another object of the present invention to provide demulsifying polymers that may be easily made.

In carrying out these and other objects of the invention, there is provided, in one form, a method for demulsifying crude oil emulsions employing a polymer which is the reaction product of a polyol (which may also have been crosslinked with a diepoxide) and an aryl compound containing one reactive functionality, preferably an epoxy, glycidyl ether or isocyanate group. The polyol is made by reacting alkylene oxide with a starting compound having at least one functional group reactive with alkylene oxide;

DETAILED DESCRIPTION OF THE INVENTION

A range of compositions of matter useful for breaking petroleum emulsions of the water-in-oil variety has been discovered. The compositions are made by reacting conventional polyol-type demulsifiers, such as polypropylene glycol, or cross-linked derivatives of such demulsifiers with various hydrophobic, aromatic hydrocarbons containing only one reactive functionality. By reactive functionality is meant a functional group that reacts with a hydroxyl group. It was discovered that terminating the chains of such conventional demulsifiers with an aromatic hydrocarbon functionality significantly affects the demulsifying characteristics of the resulting polymer. It was further found that only a relatively small amount of the aromatic hydrocarbon is necessary to have a substantial impact on performance, usually only a few percent of the total composition.

Again, it is important to note that individual demulsifiers can be extremely crude oil- or region-specific. That is, failure of a demulsifier to work on one or two tests does not mean that the demulsifier is unsuitable everywhere. This fact makes it extremely difficult to judge the worth of a particular potential demulsifier based on a few negative results alone, unless there is a large volume of negative data. Positive results, however, may point to the worth not only of the demulsifier itself, but of the class of chemistry such demulsifier represents. Thus, while there may be more negative performance results than positive results for the entire set of demulsifiers which this invention encompasses, the existence of several cases of outstanding positive performance gives credibility to the invention as a whole.

Polyether Polymer Reactant

As noted, the invention involves the reaction products of a polyol and an aromatic hydrocarbon containing a single reactive functionality. The polyol may be made in a conventional manner by the reaction of an alkylene oxide with a starting compound having at least two functional groups. Such reactions are well known in the art and may be catalyzed by alkali metal hydroxides or other catalysts such as double metal cyanide catalysts. For the purposes of this invention, suitable starting compounds having at least two functional groups include, but are not necessarily limited to, glycerol, propylene glycol, trimethylol propane (TMP), sorbitol, sucrose, polyethyleneimine, pentaerythritol, tripentaerythritol and alkylphenol-formaldehyde resin polymers, other alkylphenol-based resins, alkanolamines, alkylamines, aryl or aromatic amines, α-methylglucoside, β-methylglucoside or other methylglucoside, aniline and mixed phenol aniline, such as methylenedianiline or bisphenol A, Mannich condensates and mixtures thereof.

Appropriate alkylene oxides to add to the starting compounds include, but are not necessarily limited to ethylene oxide, propylene oxide, butylene oxide and mixtures thereof. If more than one alkylene oxide is used, they may be added as a block to the polyol, or as a mixture. Ethylene oxide (EO) and propylene oxide (PO) are preferred. In one embodiment of the invention, from about 2 to about 100 moles of alkylene oxide per reactive hydroxyl or amine functionality are added to the starting compound to make the polyol; preferably from about 5 to about 40 moles of alkylene oxide are used.

The polyols useful in this invention may optionally be crosslinked, but may be quite suitable without crosslinking. A preferred crosslinking agent is a diepoxide, and an especially preferred crosslinking agent is the diepoxide made by reacting Bisphenol A with epichlorohydrin. Other suitable crosslinking agents include, but are not necessarily limited to, resinous epoxy polyethers obtained by reacting an epihalohydrin, e.g. epichlorohydrin, with either a polyhydric phenol or a polyhydric alcohol. An illustrative, but by no means exhaustive, listing of suitable dihydric phenols includes 4,4'-isopropylidine bisphenol; 2,4'-dihydroxydiphenylethylmethane; 3,3'-dihydroxydiethylmethane; and 3,4'-diphenylmethylpropylmethane, etc.

Aromatic Hydrocarbon Reactant with a Single Reactive Functionality

While it is well known to react diepoxides with polyols to make higher molecular weight polyols, it is not believed to be known to react aromatic hydrocarbons having a single reactive functionality with the types of polyols described in this invention for any purpose, particularly to give demulsifiers with improved performance. Presently, the approach is to use polyols alone as demulsifiers, or attempt to react them with diepoxides in an effort to obtain a higher molecular weight polymer, by way of crosslinking the polyol strands.

The present invention is not concerned with molecular weight alteration, and does not involve crosslinking (although crosslinked polyols may optionally be used as a reactant with the aromatic hydrocarbon). Indeed, from the point of view of this invention, crosslinking is looked upon as an unfavorable process, since it can be difficult to control, resulting in gellation of the product during manufacture.

Without wishing to be bound by any one theory, it is likely that the use of aromatic hydrocarbons with a single reactive functionality seems to increase the ability of the demulsifier to penetrate aromatic asphaltene layers which surround and isolate water droplets in crude oil emulsions. The increased penetrability should improve the overall effectiveness of the demulsifier by getting the demulsifier to the interface faster.

As noted, the aromatic hydrocarbon reactants must have at least one aryl group and only one reactive group. The reactive group must react with hydroxyl groups and is preferably an epoxy, glycidyl ether or isocyanate group. In one embodiment of the invention, they have the formula:

(I)

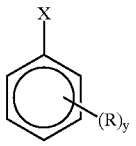

where X is a reactive functionality preferably consisting of an oxirane ring, a glycidyl ether or an isocyanate, where y ranges from 0 to 5, and where R is a hydrocarbon substituent containing from 1 to 15 carbon atoms arranged in straight, branched or cyclic groups of aliphatic or aromatic character. R may contain unsaturation, or may be saturated. Examples of suitable, specific aromatic hydrocarbons containing a single reactive functionality include, but are not limited to, styrene oxide, naphthyl glycidyl ether, epoxide derivatives of cardanol, phenyl glycidyl ether, phenyl isocyanate and the like.

Examples of suitable structures include styrene oxide, which has the formula:

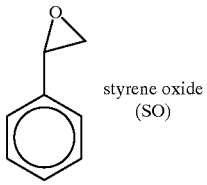

where in formula (I) above, X is an oxirane ring and y=0. Another example is the condensation product of cardanol, of cashew nutshell liquid/oil, with epichlorohydrin which has the formula:

(A)

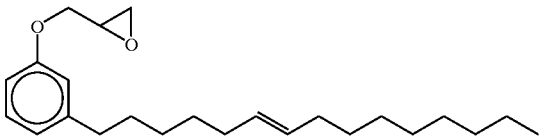

where in formula (I) above, X is a glycidyl ether group and y=1, and R is an alkylene group containing 15 carbon atoms. This latter material is designated in the Examples that follow as epoxide cap A.

Reaction Conditions

The polyol reactant may be reacted with the aromatic hydrocarbon under relatively mild conditions. For example, ambient pressures may be used, and the temperature may range from about 25° C. to about 140° C., preferably from about 60° C. to about 140° C. Preferred proportions are based on the ratio of aromatic hydrocarbon equivalents to hydroxyl equivalents. In one embodiment of the invention, this molar equivalent ratio preferably ranges from about 0.1 to about 1.2. In some instances, greater amounts of epoxy may be desirable.

Demulsification Utility

It will be appreciated that exact proportions of demulsifying compositions will vary with the particular crude emulsion, and even for crude from the same well, over time, the optimum amount of demulsifier will vary as the production conditions change. For example, different temperature and pressure conditions, concentrations of naturally occurring emulsifiers, production techniques, etc., make it impossible to predict in advance the demulsifier proportions required.

Nevertheless, to give an example under one embodiment of the invention, the proportion of demulsifier ranges from about 2 ppm to about 1000 ppm, preferably from about 5 ppm to about 500 ppm.

A typical bottle test procedure used in determining demulsification efficacy was as follows:

Several gallons of fresh crude oil emulsion are collected directly from the treating facility, at a point prior to conventional chemical injection to ensure that the sample is free of other demulsifier. The demulsifier to be tested is injected, via a microliter syringe from a 40% active solution, into 100 ml of the emulsion in a glass bottle. The bottles are capped and usually shaken with an automated shaker for 5–10 minutes. The bottles are then placed in a water bath set to a temperature that corresponds as closely as possible to the commercial system temperature. The amount of water that has separated is recorded at regular time intervals. The total time allotted for this part of the test corresponds to the estimated time of residence in the commercial treating system (usually several hours). The bottles are then individually removed from the bath, and the oil sampled with a special syringe designed not to pull oil from deeper than the syringe, at a point approximately 20 ml above the water/oil interface. This sample is treated, diluted 50% with solvent and centrifuged to determined total residual water. Unresolved emulsion is recorded as "BS" for basic sediment. These results are referred to below as the "thief cut". The formation of appreciable "pad" or unresolved emulsion between the oil phase and the water phase is undesirable. During the test, the nature of the interface between the oil phase and water phase is observed and recorded. A "good" interface is one which is sharp and well defined. The presence of large, uncoalesced "bags" or finer unresolved emulsion ("pad") is undesirable. A ragged, uneven interface is designated "fair" or "poor", depending on the extent.

The invention will now be demonstrated using syntheses of compositions of the invention and use thereof as demulsifiers. These examples are illustrative only and are not intended to limit the invention in any way.

EXAMPLE 1

To a 500 ml flask were added 261.5 g of an alkoxylated trimethylolpropane with a hydroxyl number of 26.0. Two grams of aqueous 45% potassium hydroxide were added, whereupon the mixture was heated to 140° C. and dried with nitrogen to <0.1% moisture. To this mixture was added 10.5 g of the glycidyl ether of cardanol (epoxide cap A; 0.75 epoxy per OH equivalent). The mixture was stirred at 140° C. for four hours, then cooled and discharged. The resultant product was observed to exhibit useful demulsifving properties on a sample of crude oil emulsion, as reported in Table I.

EXAMPLE 2

To a 250 ml flask were added 95 g of a polyol, made by crosslinking a polypropylene glycol (PPG) with a diepoxide of bis-phenol A and epichlorohydrin, followed by additional propoxylation, with 5.0 g of the glycidyl ether of cardanol (epoxide cap A). The mixture was stirred for two hours, then discharged. The resultant product was observed to exhibit useful demulsifying properties on a sample of crude oil emulsion, as reported in Table I.

EXAMPLE 3

150.0 g of an alkoxylated, sorbitol-based polyol (comparative polyol W) were charged to a 250 ml flask, heated to 130° C. and dried to a moisture level <0.1% with a dry nitrogen sparge. The contents of the flask were cooled to 80° C., and 12.45 g of phenyl isocyanate (PI) were added in three increments. After each addition, the mixture was allowed to react for 30 minutes. The final product was found to exhibit superior water drop characteristics as compared to the original, unreacted polyol (comparative polyol W) in tests carried out on a crude oil emulsion; see Table I.

EXAMPLE 4

To a 250 ml flask were added 110.0 g of an alkoxylated, 50,000 molecular weight polyol (comparative polyol X) to which 3.5 g of a 25% potassium hydroxide in methanol were added. The mixture was heated and stirred to 130° C. and dried with nitrogen for one hour. The mixture was cooled to 120° C. at which point 4.4 g of styrene oxide (SO) were added. After 3.5 hours at 120° C., the product was discharged. Subsequent testing revealed that the reacted product separated water from a crude oil emulsion at a faster rate than the original, unreacted polyol (comparative polyol X) which was used as a control in Table I.

EXAMPLE 5

154.4 g of an alkoxylated, 10,000 molecular weight sorbitol-based polyol that was crosslinked with a bis-phenol A-epichlorohydrin-based diepoxide (comparative polyol Y) were charged to a 250 ml flask, heated to 140° C. and dried to a moisture level <0.1% with a dry nitrogen sparge. 4.1 g of phenyl glycidyl ether were then added and the mixture stirred for one hour, whereupon 2.2 g of the glycidyl ether of cardanol were added (epoxide cap A). The mixture was stirred for 1.5 hours and discharged. Subsequent testing revealed that the final product showed improved performance over the original, unreacted crosslinked sorbitol polyol (comparative polyol Y, please see Table II). The total thief cut goes up with increasing concentration for comparative polyol Y, which is highly undesirable. If a failure occurs at low concentration, increasing the chemical rate or proportion will only make the situation worse. This is referred to as overtreating, and is also noticeable in the water drop numbers and in the decreasing quality of the interface as concentration is increased. Overtreating is not evident for the Example 5 composition of this invention, thus establishing the superiority of this composition.

EXAMPLE 6

154.2 g of an alkoxylated, 10,000 molecular weight sorbitol-based polyol (comparative polyol Y) that was crosslinked with a bis-phenol A-epichlorohydrin-based diepoxide were charged to a 250 ml flask, heated to 140° C. and dried to a moisture level <0.1% with a dry nitrogen sparge. 15.2 g of styrene oxide (SO) were then added. The mixture was allowed to react for two hours, at which point it was cooled and discharged. Subsequent testing revealed that the final product showed improved performance over the original, unreacted crosslinked sorbitol polyol (comparative polyol Y, please see Table II). The total thief cut goes up with increasing concentration for comparative polyol Y, indicating overtreating, which is also noticeable in the water drop numbers and in the decreasing quality of the interface as concentration is increased. Overtreating is not evident for the Example 6 composition of this invention, thus establishing the superiority of this composition.

TABLE I

Demulsification Results for Compositions of Examples 1 through 4

| Sample | Conc. (ppm) | Water Drop (mls) for Times Shown 1' | 30' | 60' | 120' | Inter-face | Thief Cut (%) Water | BS | Total |
|---|---|---|---|---|---|---|---|---|---|
| Ex. 1 | 200 | 15 | 40 | 40 | | Good | 12 | 3 | 15 |
| " | 500 | 10 | 20 | 48 | | Good | 0.3 | 1.3 | 1.6 |
| Blank | — | 0 | 2 | 5 | | — | 36 | 20 | 56 |
| Test Temp. = 200° F. (93° C.) | | | | | | | | | |
| Ex. 2 | 150 | 5 | 35 | 54 | | Good | 0 | 2.8 | 2.8 |
| | 200 | 20 | 41 | 56 | | Good | 0 | 1.4 | 1.4 |
| Blank | — | 6 | 39 | 48 | | — | 0 | 19.0 | 19.0 |
| Test Temp. = 150° F. (66° C.) | | | | | | | | | |
| Ex. 4 | 200 | 20 | 32 | 40 | | Fair | 9 | 8 | 17 |
| " | 400 | 40 | 42 | 50 | | Fair | 1.2 | 3.2 | 4.4 |

TABLE I-continued

Demulsification Results for Compositions of Examples 1 through 4

| Sample | Conc. (ppm) | Water Drop (mls) for Times Shown 1' | 30' | 60' | 120' | Inter-face | Thief Cut (%) Water | BS | Total |
|---|---|---|---|---|---|---|---|---|---|
| Comp. X | 200 | 7 | 7 | 8 | | Fair | 10 | 6 | 16 |
| " | 400 | 11 | 14 | 14 | | Pad | 1.6 | 2.4 | 4 |
| Blank | — | 2 | 4 | 5 | | — | 20 | 46 | 66 |
| Test Temp. = 200° F. (93° C.) | | | | | | | | | |
| Ex. 3 | 600 | 25 | 30 | 30 | 30 | Bag | 3.2 | 1.2 | 4.4 |
| " | 800 | 25 | 30 | 30 | 30 | Bag | 3.2 | 2.0 | 5.2 |
| " | 1000 | 28 | 36 | 36 | 36 | Bag | 3.2 | 2.0 | 5.2 |
| Comp. W | 600 | 28 | 30 | 30 | 30 | Bag | 0.6 | 1.0 | 1.6 |
| " | 800 | 22 | 25 | 27 | 27 | Bag | 0.4 | 2.0 | 2.4 |
| " | 1000 | 21 | 22 | 22 | 22 | Bag | 0.4 | 1.6 | 2.0 |
| Test Temp. = 140° F. (60° C.) | | | | | | | | | |

TABLE II

Demulsification Results for Compositions of Examples 5 and 6
Temperature for All Tests was 218° F. (103° C.)

| Sample | Conc. (ppm) | Water Drop (mls) for Times Shown 1' | 30' | 60' | 120' | Inter-face | Thief Cut (%) Water | BS | Total |
|---|---|---|---|---|---|---|---|---|---|
| Comp. Y | 300 | 49 | 59 | 66 | 69 | Good | 0.6 | 0.4 | 1.0 |
| " | 600 | 50 | 59 | 62 | 69 | Good | 0.9 | 0.5 | 1.4 |
| " | 900 | 49 | 53 | 59 | 58 | Pad | 1.2 | 0.0 | 1.2 |
| " | 1200 | 50 | 54 | 59 | 69 | Pad | 0.9 | 0.9 | 1.8 |
| " | 1500 | 46 | 49 | 50 | 52 | Pad | 1.2 | 0.9 | 2.1 |
| Ex. 5 | 300 | 49 | 51 | 59 | 68 | Good | 1.2 | 1.1 | 2.3 |
| " | 600 | 51 | 59 | 68 | 71 | Good | 1.0 | 0.6 | 1.6 |
| " | 900 | 52 | 60 | 68 | 70 | Good | 0.6 | 0.7 | 1.3 |
| " | 1200 | 51 | 60 | 64 | 69 | Good | 0.8 | 0.7 | 1.5 |
| " | 1500 | 55 | 60 | 61 | 68 | Good | 0.4 | 0.8 | 1.2 |
| Ex. 6 | 300 | 51 | 53 | 60 | 68 | Good | 0.8 | 1.1 | 1.9 |
| " | 600 | 55 | 59 | 67 | 70 | Good | 1.6 | 0.6 | 2.2 |
| " | 900 | 56 | 61 | 68 | 71 | Good | 1.4 | 0.1 | 1.5 |
| " | 1200 | 57 | 62 | 68 | 71 | Good | 0.9 | 0.4 | 1.3 |
| " | 1500 | 59 | 62 | 68 | 70 | Good | 0.6 | 0.4 | 1.0 |

The compositions and methods of the invention have been demonstated with respect to a number of other polyol reactants, variosly with styrene oxide and the glycidyl ether of cardonal (epoxide cap A). All of Examples 7 through 19 presented below in Table III were prepared similarly to the procedures described above for Examples 1–6 with the indicated reactants. All have shown demulsification activity in separating a crude oil emulsion into an oil phase and a water phase for at least one emulsion.

TABLE III

Examples 1–19: Summary of Demulsifier Preparations

| Ex. | Polyol | Epoxide Cap |
|---|---|---|
| 1 | Alkoxylated TMP | A |
| 2 | Crosslinked PPG with additional PO | A |
| 3 | Alkoxylated sorbitol-based polyol | PI |
| 4 | Alkoxylated 50,000 MW polyol | SO |
| 5 | Alkoxylated, 10,000 MW sorbitol-based polyol, cross-linked | A |
| 6 | Alkoxylated, 10,000 MW sorbitol-based polyol, cross-linked | SO |
| 7 | Alkoxylated, 10,000 MW sorbitol-based polyol | A |
| 8 | Alkoxylated tripentaerythritol (TPE)-based polyol | A |
| 9 | Alkoxylated sorbitol-based polyol | A |
| 10 | Mixed alkoxylated TPE- and sorbitol-based polyol | A |

TABLE III-continued

Examples 1–19: Summary of Demulsifier Preparations

| Ex. | Polyol | Epoxide Cap |
|---|---|---|
| 11 | Alkoxylated glycerol-based polyol | A |
| 12 | Alkoxylated glycerol-based polyol | A |
| 13 | Alkoxylated glycerol-based polyol | A |
| 14 | Alkoxylated diethylenetriamine (DETA)-based polyol | A |
| 15 | " | A |
| 16 | Alkoxylated propylene glycol-based polyol | A |
| 17 | Alkoxylated methanol-based polyol | A |
| 18 | Alkoxylated methanol-based polyol | A |
| 19 | Alkoxylated TPE-based polyol | A |
| 20 | Alkoxylated propylene glycol-based polyol | SO |
| 21 | Alkoxylated, 10,000 MW sorbitol-based polyol | SO |

In the foregoing specification, the invention has been described with reference to specific embodiments thereof, and has been demonstrated as effective in resolving petroleum emulsions. However, it will be evident that various modifications and changes can be made thereto without departing from the broader spirit or scope of the invention as set forth in the appended claims. Accordingly, the specification is to be regarded in an illustrative rather than a restrictive sense. For example, specific demulsifiers made with polyols and aromatic hydrocarbons containing a single, reactive functionality falling within in the claimed parameters, but not specifically identified or tried as emulsifiers, are anticipated to be within the scope of this invention.

We claim:

1. A polymer useful in demulsifying emulsions of oil and water, comprising the reaction product of:

a polyol made by reacting alkylene oxide selected from the group consisting of ethylene oxide, propylene oxide, butylene oxide, and mixtures thereof, with a starting compound having at least one functional group reactive with alkylene oxide, where the starting compound is selected from the group consisting of glycerol, propylene glycol, trimethylol propane, sucrose, polyethyleneimine, pentaerythritol, tripentaerythritol, alkylphenol-based resins, alkanolamines, alkylamines, aryl or aromatic amines, α-methylglucoside, β-methylglucoside or other methylglucoside, aniline, methylenedianiline, bisphenol A, and mixtures thereof; and an aromatic hydrocarbon having at least one aryl group and only one reactive functionality, where the reactive functionality is a glycidyl ether moiety;

where the molar equivalent ratio of aromatic hydrocarbon to hydroxyl groups on the polyol ranges from about 0.1 to about 1.2, and where the aromatic hydrocarbon terminates the polyol.

2. The polymer of claim 1 where the aromatic hydrocarbon has the formula:

where X is a glycidyl ether moiety; where y ranges from 0 to 5, and where R is a saturated straight, branched or cyclic; aliphatic hydrocarbon substituent containing from 1 to 15 carbon atoms.

3. The polymer of claim 1 where the polyol is reacted with a diepoxide to make a cross-linked polyol prior to reaction with the aromatic hydrocarbon containing one reactive functionality.

4. The polymer of claim 1 where in the polyol, the diepoxide is made by reacting Bisphenol A with epichlorohydrin.

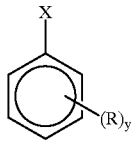

5. A polymer useful in demulsifying emulsions of oil and water, comprising the reaction product of:

a polyol made by reacting alkylene oxide with a starting compound selected from the group consisting of glycerol, propylene glycol, trimethylol propane, sucrose, polyethyleneimine, pentaerythritol, tripentaerythritol, alkylphenol-based resins, alkanolamines, alkylamines, aryl or aromatic amines, α-methylglucoside, β-methylglucoside or other methylglucoside, aniline, methylenedianiline, bisphenol A, and mixtures thereof, where the alkylene oxide is selected from the group consisting of ethylene oxide, propylene oxide, butylene oxide, and mixtures thereof; and an aromatic hydrocarbon of the formula:

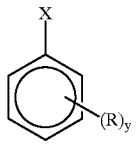

where X is a glycidyl ether moiety; where y ranges from 0 to 5, and where R is a straight, branched or cyclic; aliphatic or aromatic hydrocarbon substituent containing from 1 to 15 carbon atoms;

where the molar equivalent ratio of aromatic hydrocarbon to hydroxyl groups on the polyol ranges from about 0.1 to about 1.2, and where the aromatic hydrocarbon terminates the polyol.

6. A polymer useful in demulsifying emulsions of oil and water, comprising the reaction product of:

a polyol made by reacting alkylene oxide selected from the group consisting of ethylene oxide, propylene oxide, butylene oxide and mixtures thereof, with a starting compound having at least one functional group reactive with alkylene oxide, where the starting compound is selected from the group consisting of glycerol, propylene glycol, trimethylol propane, sucrose, polyethyleneimine, pentaerythritol, tripentaerythritol, alkylphenol-based resins, alkanolamines, alkylamines, aryl or aromatic amines, α-methylglucoside, β-methylglucoside or other methylglucoside, aniline , methylenedianiline, bisphenol A, and mixtures thereof; and an aromatic hydrocarbon selected from the group consisting of naphthyl glycidyl ether, epoxide derivatives of cardanol, and phenyl glycidyl ether;

where the molar equivalent ratio of aromatic hydrocarbon to hydroxyl groups on the polyol ranges from about 0.1 to about 1.2, and where the aromatic hydrocarbon terminates the polyol.

7. A polymer useful in demulsifying emulsions of oil and water, comprising the reaction product of:

a polyol made by reacting alkylene oxide with tripentaerythritol, where the alkylene oxide is selected from the group consisting of ethylene oxide, propylene oxide, and mixtures of the two; and an aromatic hydrocarbon of the formula:

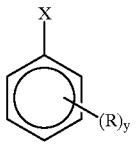

where X is a glycidyl ether moiety; where y ranges from 0 to 5, and where R is a straight, branched or cyclic; aliphatic or aromatic hydrocarbon substituent containing from 1 to 15 carbon atoms where the molar equivalent ratio of aromatic hydrocarbon to hydroxyl groups on the polyol ranges from about 0.1 to about 1.2, and where the aromatic hydrocarbon terminates the polyol.

* * * * *

UNITED STATES PATENT AND TRADEMARK OFFICE

CERTIFICATE OF CORRECTION

PATENT NO : 5,981,687

DATED : November 9, 1999

INVENTOR(S) : Patrick J. Breen and James W. Towner

It is certified that error appears in the above-identified patent and that said Letters Patent are hereby corrected as shown below:

Column 8, line 44, please delete "variosly" and insert --variously--.

Column 9, between lines 56 and 57, please insert the chemical formula:

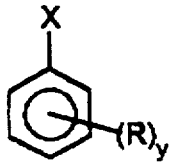

Signed and Sealed this

Tenth Day of April, 2001

*Attest:*

Nicholas P. Godici

NICHOLAS P. GODICI

*Attesting Officer*

*Acting Director of the United States Patent and Trademark Office*